United States Patent [19]

Schaefer et al.

[11] Patent Number: 4,740,407

[45] Date of Patent: Apr. 26, 1988

[54] PILE-LIKE SUBSTRATE AND METHOD OF MAKING SAME

[75] Inventors: Philipp Schaefer, Hanover; Horst Büscher, Langenhagen; Gustav Hildebrandt, Auetal; Heinrich Kracke, Lehrte; Bernd Grego, Hanover; Klaus Heimrich, Garbsen; Harald Krack, deceased, late of Langenhagen; Ewald Krack, heir; Doris Krack, heir, both of Stuttgart, all of Fed. Rep. of Germany

[73] Assignee: J. H. Benecke GmbH, Hanover, Fed. Rep. of Germany

[21] Appl. No.: 26,484

[22] Filed: Mar. 16, 1987

[30] Foreign Application Priority Data

Mar. 15, 1986 [DE] Fed. Rep. of Germany ..... 3608781
Aug. 21, 1986 [DE] Fed. Rep. of Germany ..... 3628302

[51] Int. Cl.[4] ..... B32B 33/00; D06C 11/00

[52] U.S. Cl. ..... 428/87; 427/389.9; 427/394; 427/412; 428/91; 428/95; 428/287; 428/290; 428/306.6; 428/904

[58] Field of Search ..... 428/904, 87, 91, 95, 428/287, 290, 306.6; 427/389.9, 394, 412

[56] References Cited

U.S. PATENT DOCUMENTS 4,298,644 11/1981 Shimizu et al. ..... 428/91

*Primary Examiner*—Marion C. McCamish
*Attorney, Agent, or Firm*—Karl F. Ross; Herbert Dubno

[57] ABSTRACT

A substrate having an appearance similar to that of nubuk-leather or pile-leather, respectively, or of a textile pile consists of a textile carrier body being at least partially impregnated with a, preferably cross-linked, polymeric synthetic plastics material consisting of a foam which has open cells formed by introducing air and optionally has closed cells formed of hollow microspheres. The textile carrier body consists of a fleece or of a knitting, preferably of a crimped fleece of synthetic fibres, which is needled together with a knitting or with a fleece, strengthened by thermal embossing, in such a manner that the fibres extend through the knitting. The knitting may consist of a roughened stockinet, i.e. a stockinet having opened loops. The carrier body is ground at least at its one impregnated surface and is thus rough and can be provided with a coating.

64 Claims, 2 Drawing Sheets

PILE-LIKE SUBSTRATE AND METHOD OF MAKING SAME

FIELD OF THE INVENTION

The invention refers to a substrate having the appearance of nubuk-leather or, respectively, pile-leather or of a textile pile as well as to a process for producing such a substrate.

BACKGROUND OF THE INVENTION

Non-impregnated fleeces have excellent properties with respect to puncture proofness and resistance to further tearing. Their main drawback resides, however, in that their surface is unsteady and is very strongly changed in particular when being stretched. A further drawback of these fleeces resides in their strongly varying thickness. If such fleeces are used as a carrier material for a coating of synthetic plastics material it is, for the purpose of compensating variations in thickness and for the purpose to eliminate the unsteadiness of the surface of the fleece, necessary to provide correspondingly thick and heavy and thus expensive coatings of synthetic plastics material. It has, however, been proposed to use as the coating material foamed PVC or foamed PUR, so that the weight becomes reduced, but such foamed coatings have an only low abrasion resistance and tend to splitting.

It is also known to produce the coating from an aqueous dispersion of synthetic plastics material containing either hollow microspheres or compact particles from which are formed hollow microspheres when supplying heat during solidification of the dispersion of synthetic plastics material. These hollow microspheres are closed cells, so that the coating shows a closed-cell foam structure. The mentioned drawbacks can only partially be avoided also with such a coating, because this coating must have a corresponding thickness. The closed-cell foam structure is, furthermore, not permeable for water vapour.

It is further known to make a substrate by incorporating a synthetic plastics material into a fleece. Thus it has already been proposed to introduce into a fleece a polymer solution formed of solvents miscible with water and of polyurethane and to allow to coagulate this solution, the liquid polymer solution becoming solidified during coagulation. Subsequently, the solvent is removed by washing with water, whereby open-cell pores are formed. Such a procedure is circumstantial. Furthermore, the solvents used are toxic and harmful to the environments. A further drawback resides in that only thermoplastic synthetic plastics material can be used for such a procedure and in that such synthetic plastics materials give rise to problems because they tend to smearing on grinding.

There has also already been proposed a process for producing porous flat shaped articles of textile having a leather-like grain, according to which process a base fabric of shrinkable fibres is impregnated at one side or at both sides with a flowable and heat-reactive polymer having, for example, been given a foam-like condition by introducing air, whereupon the impregnated fabric is allowed to dry by supplying heat and is allowed to shrink by a treatment with water or steam (DE-A-No. 21 64 852). There results an absorbent flat shaped article having a leather-like grain and which can be used as a dish rinsing cloth, scrubbing cloth, wiping cloth on the like. In this case it is a premise to use a fabric of natural fibres which shrink during washing, so that there results a leather-like grain but no oile effect. If this known flat shaped article is stretched or extanded, there results, on account of the utilization of the fabric, equally an unsteady, uneven sight surface. The use of this fabric makes difficult the production of exact cut edges because the fabric tends to fraying.

It is also known to impregnate a carrier body formed of a fabric, knitting or fleece with a synthetic plastics material having properties of an elastomer or similar to that of an elastomer and having embedded therein hollow microspheres, noting that the surfaces of the substrate thus produced have been worked by grinding operation or the like and thus show partially opened hollow microspheres (DE-C2-No. 31 17 721). There results a pile effect at the surface of the substrate now having a low density on account of the embedded hollow microspheres and having also a plane surface, but the substrate thus formed is not or scarcely permeable for water vapour and is also relatively stiff. The tearing resistance, the stitching resistance and the humidity absorption are equally unsatisfactory and the application of a coating is not possible.

In general, it is difficult to correctly predetermine the amount of synthetic plastics material, which amount is mainly dependent on the content in solid matter of a solution or dispersion, to be introduced into a fleece, which is subsequently ground, for obtaininq a nubuk or pile effect. A high content of the solution or dispersion in solid matter results in a hard, stiff product of low porosity and thus of negligible absorbency and of poor tearing resistance and stitching resistance, while a low content in solid matter has as an effect that the synthetic plastics material is mainly accumulated at the crossing points of the fibres, in consequence of which the tearing resistance and the stitching resistance is equally poor and the material becomes cornered on bending and can be ground only with great difficulties. A further disadvantage is the low abrasion resistance of the material and the high energy requirement for evaporating the water or the solvent.

The term "impregnate" is, in the present case, to comprise not only immersion of the textile material into a bath but also each other method for applying a liquid onto the textile material.

OBJECTS OF THE INVENTION

It is an object of the invention to provide a substrate having the appearance of nubuk-leather or, respectively, pile-leather or of a textile pile and having a plane, steady, fine-fibrous surface which becomes not pulled open, i.e. does not become unsteady. even in case of a strong elongation of the substrate, so that this substrate can be provided with a thin coating directly connected with the substrate, but can, however, also be used without such a coating. It is a further object of the invention to provide a substrate which has a good tearing strength and stitching strength and good humidity absorbency as well as a good permeability for water vapour and air, whereby the hygienic properties are improved in case of an application in shoes. There shall further be provided a substrate which has good abrasion properties, a low weight, approximately the same stretching properties in longitudinal direction and in transverse direction and a constant bending stiffness within a broad temperature range and is not or, respectively, not markedly thermoplastic. Furthermore, the substrate shall be suitable for being easily and permanently be deformed, which is of importance when using the substrate in shoe production as well as as an upholstery material for cushions and for the interior panelling of vehlcles. It is a further object of the invention to build up a substrate such that the cavities between the fibres of the carrier material are nearly completely and uniformely filled up at least within a marginal area of the carrier material formed of textiles, so that any accumulation of synthetic plastics material at the crossing points is avoided and the substrate thus has a low bending stiffness. The substrate shall further have a pile-like surface of neat shape, shall be permeable for water vapour and air and have favourable premises for being inseparably connected with a thin coating.

A still further object of the invention is to build up a substrate such that it is particularly suitable as a leather substitute and in particular as a material for the inside equipment of vehicles, in particular of motor vehicles, because it is stretchable and can well be deformed.

BRIEF DESCRIPTION OF THE DRAWINGS

In the annexed drawings, there are shown examples of embodiment of a substrate according to the invention.

SPECIFIC DESCRIPTION

Figure 1:
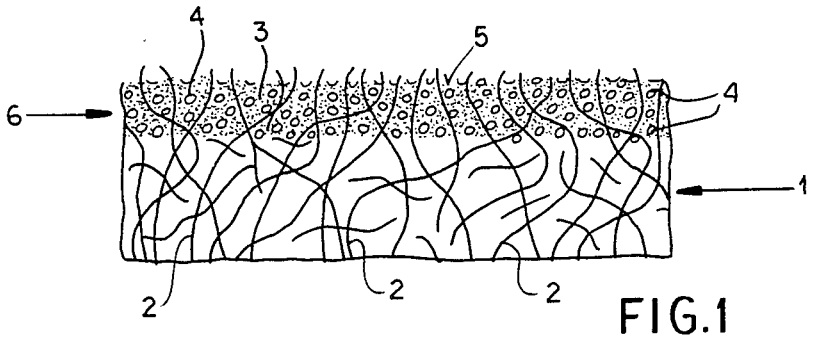
FIG. 1 shows a substrate according to the invention without coating.

The inventive substrate shown in FIG. 1 has a carrier body formed of a fleece 1, said carrier body being formed of synthetic fibres, for example of polyester fibres or polyamide fibres 2. An impregnation consisting of a foam 3 is provided at the area 6 of the substrate located adjacent the surface 5. The impregnation may have only open cells by stirring thereinto air, but there can also be embedded into the open-cell foam hollow microspheres forming closed cells, as is shown at 4. The impregnated surface 5 has been ground and the fibres 2 extend out of this surface 5 and protrude from this surface, respectively, so that this surface has the appearance similar to that of nubuk-leather or, respectively, pile-leather or of a textile pile.

Figure 2:
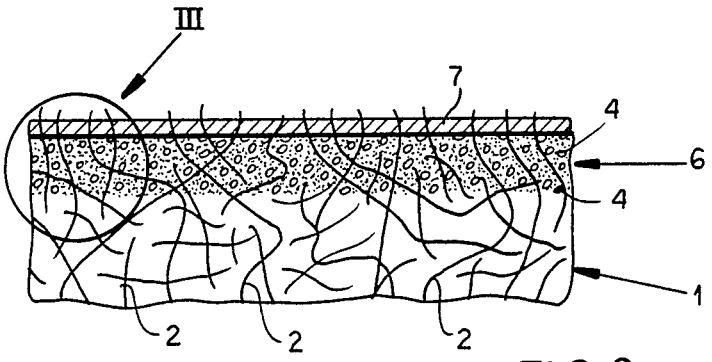
FIG. 2 shows a substrate according to the invention and a coating applied thereon.
Figure 3:
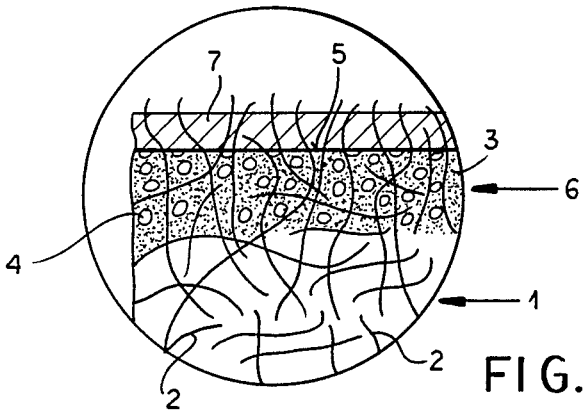
FIG. 3 shows the detail III of FIG. 2 in a greater scale.

The embodiment according to FIGS. 2 and 3 differs from that according to FIG. 1 in that a thin coating 7, for example of polyurethane or PVC, is inseparably connected with the surface 5, the coating 7 having the appearance similar to grain leather and the fine fibres protruding from the surface 5 extending into this coating and thus being anchored within this coating 7 or this fine fibres even penetrating said coating and extending out of this coating. The thickness of the coating may, in this case, be less than 0.35 mm. The coating 7 can, however, even be applied to the not impregnated surface of the fleece 1, whereby the fibres 2 of the fleece 1 become equally anchored within the coating. In this case, the surface provided with the coating has preferably an appearance similar to that of grain leather, whereas the other, impregnated and ground surface 5 is given the appearance similar to that of a pile.

Figure 4:
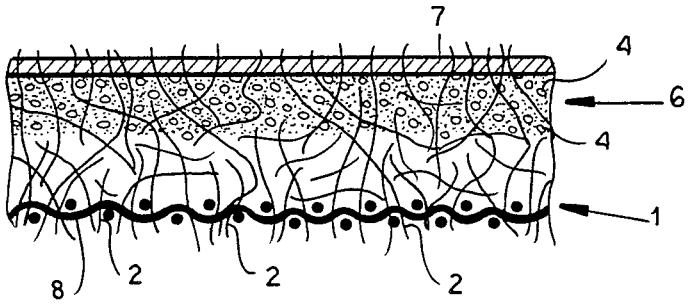
FIG. 4 shows a further embodiment of the substrate according to the invention together with a coating.

The embodiment according to FIG. 4 differs from the embodiment according to FIG. 3 in that a knitting or a thin fleece 8 strengthened by thermal embossing and having a thickness of less than 0.8 mm and having a weight per unit area if less than 135 g/m$^2$ is needled with the fleece 1 such that the fibres 2 of the fleece 1 penetrate through the knitting or the strengthened fleece 8 and thus protrude from the top surface of this knitting or strengthened fleece 8, respectively. In this case, the knitting may consist of a roughened stockinet, in particular of a stockinet having opened loops. In place of the knitting or fleece 8, respectively, there can be provided a foil of synthetic plastics material made of polypropylene, polyethylene or soft PVC needled together with the fleece 1, noting that the fibres of the fleece 1 extend through the synthetic plastics material. Also in this embodiment, the coating 7 may be arranged on the impregnated surface 5 of the fleece 1 as well as on the knitting or strengthened fleece 8, respectively, noting that also in the latter case the protruding fibres 2 become anchored within the coating.

Figure 5:
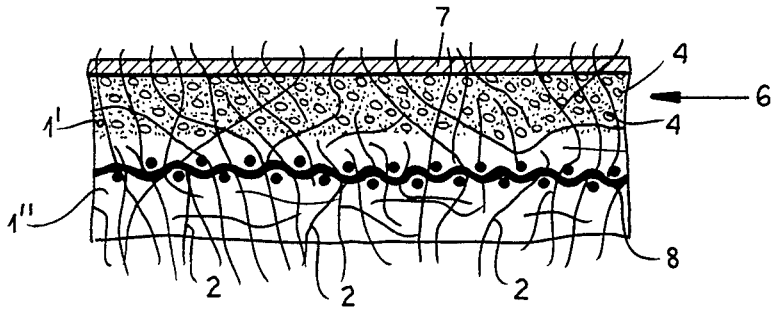
FIG. 5 shows a further embodiment of the substrate according to the invention together with a coating.

The embodiment according to FIG. 5 differs from that according to FIG. 4 in that the carrier body consists of two fleeces 1', 1", between which is arranged a knitting or a thin fleece 8 being strengthened by embossing and being needled together with both fleeces 1', 1". The knitting or fleece 8, respectively, may also be omitted, so that said both fleeces 1', 1" are directly needled together.

Although in the embodiment shown, only the area 6 located adjacent the surface 5 is provided with an impregnation, it is, however, also possible to impregnate or soak, respectively, the areas located adjacent both surfaces of the carrier body or even the whole carrier body. As already mentioned, it is further possible to form the impregnation only of an open-cell foam, in which case no hollow microspheres 4 are provided. The fleece 1 or, respectively, 1' or, respectively, 1" is preferably a crimped fleece of synthetic fibres but can also consist of natural fibres. The fibres 2 are conveniently thinner than 3.5 dtex, preferablv thinner than 2 dtex.

The carrier body formed of textiles may preferably contain a proportion within 5 and 35 percent of fibres 2 of high strength, in particular fibres based on polyamide. Such high-strength fibres are available in the German Federal Republic under the trade mark KEVLAR and NOMEX. In particular in case of an only partially impregnated textile carrier body, there exists the possibility to use such high-strength fibres, whereby the tensile strength of the substrate is substantially increased. In case of such a substrate, there can be used as the carrier body a thin fleece 1 of low weight having a weight per unit area of approximately 150 g/m$^2$, so that this substrate is, for example, particularly suitable as a material for shoe uppers.

A beautiful and uniform pile effect results if the major part of the cells of the polymeric synthetic plastics material is smaller than 125 $\mu$m.

The polymeric synthetic plastics material is preferably at least partially cross-linked, noting that a cross-linking agent is added which does not start cross-linking with accompanying heat generation.

A polymeric synthetic plastics material of particularly good suitability is a polymer dispersion based on butadiene, polyurethane, polyacrylate, polystyrene, polyisobutylene and/or polychloroprene or containing these polymers. The open-cell beaten foam can well be produced with such materials.

For further improving the humidity absorbency and the humidity permeability of the substrate, the polymeric synthetic plastics material may contain pulverulent hygroscopic additives, for example leather flour or cellulose powder, which take up and pass on the humidity.

The textile carrier body can, starting from its both mutually opposite surfaces, be soaked within a respective area of its whole thickness with different polymeric synthetic plastics material. This results in the advantage that the polymeric synthetic plastics material can be adapted to the existing requirements. It is thus possible to obtain a special effect by suitably selecting the synthetic plastics material used within the visible and ground surface, to influence the properties of the substrate by selecting the synthetic plastics material arranged within the area of the backside of the substrate and to improve the interconnection between the substrate and a carrier body formed, for example, of a fleece 1 when using suitable adhesives.

For the purpose of obtaining a low bending stiffness and a good stitching strength and tearing strength it is of importance that no synthetic plastics material is accumulated at the crossing points of the fibres 2 and this for the purpose of avoiding a strong bond between the carrier body 1 and the synthetic plastics material. This is the case when using svnthetic plastics material having been given a foam-like structure. A reduction of this bond and thus an improved stretchability of the substrate in all direction can, however, also be obtained by providing the textile carrier body with an anti-adhesion dressing formed of a layer at least partially enveloping the fibres forming the carrier body. This layer may, for examole, consist of silicone, polytetrafluorethylene, polyethylene, wax, paraffin, polyolefine or like materials, or of mixtures thereof, but may also consist of materials which are primarily water-repellent and thus prevent any deposition of the dispersion on the fibres.

However, the layer may also consist of a soluble substance, for example of gelatine, starch, soaps, fatty alcohols, polyvinylalcohol, water glass or mixtures thereof, being soluble in a liquid, in particular water or alcohol. This layer surrounds at first the fibres and prevents any deposition of the synthetic plastics material on the fibres, in particular also at the crossing points, but can at least partially be again removed by the liquid (water, alcohol or the like), during or after solidification of the synthetic plastics material, so that the fibres are then quasi freely movable within the foam of synthetic plastics material and the softness and flexibility of the thus produced substrate is not only improved but also capillary cavities are formed within the substrate which increase the permeability for humidity in the desired manner. There exists, however, also the possibility that this layer becomes absorbed by the aqueous dispersion of synthetic plastics material itself.

It is of advantage if the substrate is at least at one surface provided with a printing and is provided with a, preferably transparent, finish, thereby obtaining the desired appearance, for example an appearance similar to that of leather or of a textile product.

When producing a nubuk-like or, respectively, a pile-leather-like substrate or a substrate similar to a textile pile, the procedure is such, that at least onto one surface of a textile carrier body consisting of fibres, an aqueous dispersion of synthetic plastics material, which has been given a foam-like condition by beating thereinto air, is applied or introduced therein under the action of increased pressure and/or reduced pressure, that subsequently the thus impregnated carrier body is dried by removing water and that finally at least one impregnated surface of the carrier body is ground. Introduction of the beaten foam under the action of increased pressure is, for example, effected by applying pressurized air or a pressurized gas and/or by mechanically forcing the beaten foam into the carrier body. Introduction of the beaten foam under the action of increased pressure and/or reduced pressure makes sure that the foam structure is not destroyed during introduction into the carrier body but is maintained to the desired degree within that area of the carrier member which is to be impregnated. During the subsequent drying step effected by heat supply and preferably at a temperature exceeding 100° C., a great number of cell walls are bursting within the drying beaten foam on account of the expansion of the air within the beaten foam which results to a high degree in the desired permeability for air and water vapour. The use of a beaten foam results in the further advantage that the volume of the beaten foam is approximately twice the volume of the non-beaten dispersion without changing the ratio between water and solid matter, so that a smaller amount of water is required for impregnating the desired area of the textile carrier body and also a lower amount of water must be removed during the drying step. This results in savings with respect to material and energy.

If the impregnation shall partially also contain closed cells, there can be added to the aqueous dispersion of synthetic plastics material, which dispersion has been brought into a foam-like condition by introducing therein air, hollow microspheres formed of a thermoplastic synthetic plastics material, preferably of polyvinyl chloride, or compact particles of a thermoplastic synthetic plastics material, preferably polyvinyl chloride, containing an inflating agent, from which compact particles hollow microspheres are formed in situ by supplying heat. If the hollow microspheres are formed from the compact particles when drying the impregnated carrier body, also the beaten foam is thereby expanded, which equally results in bursting of the cell walls. The hollow microspheres being formed during the drying step furthermore result in a spontaneous increase of the viscosity of the still liquid beaten foam and thus not only prevent contraction of the drying beaten foam at the crossing points of the fibres and a reduction of the volume of the beaten foam on account of the loss in liquid during the drying step, but the beaten foam is increased in volume by the generated hollow microspheres.

It is of advantage if the aqueous dispersion of synthetic plastics material is subjected, for example by means of a substance like polyvinyl methyl ether, to heat sensitive measures or is adjusted to a pH-value being different from the pH-value of the textile carrier body or, respectively, of the fibres forming this textile carrier body, i.e. is within the acidic or alcaline range in contrast to the textile carrier body. In each case, this results in coagulation of the dispersion of the synthetic plastics material, whereby said solidification of the dispersion is accelerated and an additional foam formation is provoked.

For the purpose of reducing the bending strength of the substrate, it is advisable to subject the impregnated carrier body after having been dried to a chemical treatment, for example by means of hot water, or, preferably under simultaneous application of heat, to a mechanical treatment, for example by elongating, stretching and/or tumbling, which equally results in loosening the bond between the fibres of the textile carrier body and the solidified foam of synthetic plastics material, in particular at the crossing points of the fibres.

If the hollow microspheres are formed in situ when drying the foam of synthetic plastics material, this is accompanied, as already mentioned, in a volume increase during the drying process which results in an increase of the thickness of the impregnated textile carrier body. This increased thickness is now conveniently removed by the grinding treatment, whereby the desired thickness of the substrate is reliably obtained independent of the applied amount of beaten foam, but also results a completely constant thickness of the substrate even if the carrier material had a varying thickness prior to the impregnating step.

The impregnated carrier body can be provided at least at its one surface with an embossing under the action, of pressure and heat. Furthermore, the impregnated carrier body can be provided with a printing, thereby preferably using a printing ink containing as a binding agent polymethacrylic acid methyl ester or polyurethane. If the substrate shall be combined with applied PVC-foils as is, for example, of advantage if the substrate is used for the inside equipment of vehicles, the printing ink acts in such a case as a high frequency welding agent for welding thereon these PVC-foils. Furthermore. the impregnated carrier body can, preferably after having been provided with a printing, be provided with a transparent finish and/or be subjected to a dying operation after having been ground. Because the inventive substrate has humidity absorbing properties, the substrate can, in this case, unobjectionably be dyed over its whole cross section.

EXAMPLES

EXAMPLE 1

For producing an inventive substrate, an aqueous dispersion of synthetic plastics material having been beaten or, respectively, stirred to a foam condition and having a weight between 300 and 700 g, preferably of 500 g/per liter is introduced by coating under increased pressure and/or reduced pressure into a needle fleece or an eddy fibre fleece of fine fibres and having a weight per unit area of more than 180 g/m$^2$. Subsequently, the dispersion within the fleece is solidified and dried, respectively, by evaporating water. This solidification or drying, respectively, is, for example, effected by directly contacting the surface of the fleece with a hot supporting member, for example a hot roll or plate, so that the heat is directly transmitted to the wet dispersion layer. After the drying step, the soaked surface of the fleece is ground by means of an emery paper, thereby removing the open surface of the fleece existing prior to impregnating the fleece with the beaten foam and removing the considerable variations of the thickness of the fleece. The surface of the fleece has now the appearance similar to that of nubuk-leather or, respectively, pile-leather having fine, sharpened fibres and can be provided with a thin coating.

EXAMPLE 2

100 parts of a 50 percent polymer dispersion based on butadiene and containing a cross-linking agent becoming active on heat supply is mixed with an additive comprising 2 parts thickening agent, 5 parts pigment and 5 parts of thermoplastic compact particles containing an inflating agent. The mixture is subsequently thoroughly mixed and and air is stirred therein until the volume has become approximately twice the original volume and a beaten foam has been formed. This beaten foam is introduced under the action of increased pressure into a needle fleece having a weight per unit area of approximately 300 g/m$^2$ and a thickness of approximately 2 mm and consisting of 50 parts cotton fibres and 50 parts polyester fibres (1.7 dtex) such that the beaten foam penetrates the fleece for approximately 0.6 mm.

The thus impregnated fleece is subsequently dried at a temperature of approximately 135° C. During drying there are formed within the beaten foam and from the compact particles the thermoplastic hollow microspheres. Drying is finished after approximately 3 minutes. The fleece, in which were formed the hollow microspheres, has now a thickness of approximately 2.2 mm.

Subsequently, the fleece is ground on the treated side with an emery paper, granulometry 220, i.e. for a time interval until the fleece has again its original thickness of 2 mm. After the grinding operation, the opened surface of the fleece being present prior to impregnating the fleece with the beaten foam and the considerable variations of the thickness of the fleece are eliminated. The surface of the fleece shows a surface similar to that of nubuk-leather or pile-leather and has fine, sharpened fibres. This surface is plane to such an extent that a thin PUR-coating applied in a known manner and having a thickness of 0.18 mm does not allow to detect any fleece structure also when being stretched.

What we claim is:

1. Pile-like substrate comprising a textile carrier body consisting of fibres and having a rough surface on at least one side and being at least partially impregnated with a polymeric synthetic plastics material having been given a foam-like condition by introducing therein air and being ground at least at its one impregnated surface such that the fibres of the carrier body protrude at least partially out of this surface.

2. Substrate according to claim 1, noting that the polymeric synthetic plastics material has, in addition to the open cells formed by introducing air, closed cells formed of hollow microspheres.

3. Substrate according to claim 2, noting that at least some hollow microspheres located at the impregnated surface of the carrier body are opened.

4. Substrate according to claim 1, noting that the carrier body contains a fleece.

5. Substrate according to claim 4, noting that the fleece consists of a crimped fleece.

6. Substrate according to claim 1, noting that the carrier body contains a knitting.

7. Substrate according to claim 6, noting that the knitting consists of a roughened stockinet.

8. Substrate according to claim 1, noting that the carrier body consists of a fleece of natural fibres and a fleece of synthetic fibres, the latter fleece being needled together with the fleece of natural fibres.

9. Substrate according to claim 1, noting that the carrier body consists of at least one fleece and a knitting needled together with said fleece, the fibres of the fleece extending at least partially through the knitting.

10. Substrate according to claim 9, noting that the carrier body consists of two fleeces, between which is arranged a knitting which is connected with said both outer fleeces by needling.

11. Substrate according to claim 1, noting that the carrier body consists of at least one fleece and a further fleece needled together with said first mentioned fleece and being strengthened by embossing, the fibres of said first mentioned fleece at least partially extending through the second-mentioned fleece.

12. Substrate according to claim 11, noting that the carrier body consists of two fleeces between which is arranged a thin further fleece being strengthened by embossing, said further fleece being connected with said both first-mentioned fleeces by needling.

13. Substrate according to claim 1, noting that the carrier body consists of at least one fleece and a foil of synthetic plastics material needled together with said fleece, the fibres of the fleece extending through the foil of synthetic plastics material.

14. Substrate according to claim 13, noting that the foil of synthetic plastics material consists of polypropylene.

15. Substrate according to claim 13, noting that the foil of synthetic plastics material consists of polyethylene.

16. Substrate according to claim 13, noting that the foil of synthetic plastics material consists of soft PVC.

17. Substrate according to claim 1, noting that the carrier body consists at least partially of synthetic fibres.

18. Substrate according to claim 17, noting that the carrier body consists of polyester fibres.

19. Substrate according to claim 17, noting that the carrier body consists of polyamide fibres.

20. Substrate according to claim 17, noting that the fibres are thinner than 3.5 dtex.

21. Substrate according to claim 1, noting that the carrier body contains at least partially fibres of high strength.

22. Substrate according to claim 1, noting that, starting from one surface of the textile carrier body, only part of the total thickness of the carrier body is impregnated.

23. Substrate according to claim 1, noting that the major part of the cells of the polymeric synthetic plastics material is smaller than 125 $\mu$m.

24. Substrate according to claim 1, noting that the polymeric synthetic plastics material is, at least partially, cross-linked.

25. Substrate according to claim 1, noting that the polymeric synthetic plastics material is formed of a polymer dispersion.

26. Substrate according to claim 1, noting that the polymeric synthetic plastics material contains pulverulent hygroscopic additives.

27. Substrate according to claim 26, noting that the polymeric synthetic plastics material contains leather flour.

28. Substrate according to claim 26, noting that the polymeric synthetic plastics material contains cellulose powder.

29. Substrate according to claim 1, noting that the carrier body is, starting from its mutually opposite surfaces, impregnated for a respective area of its total thickness with a different polymeric synthetic plastics material.

30. Substrate according to claim 1, noting that the textile carrier body is provided with an anti-adhesion dressing formed of a layer at least partially enveloping the fibres forming the carrier body.

31. Substrate according to claim 30, noting that said layer consists of silicone, polytetrafluorethylene, polyethylene, wax, paraffin, polyolefine or like materials or of mixtures thereof.

32. Substrate according to claim 30, noting that said layer consists of a substance being soluble in a liquid.

33. Substrate according to claim 32, noting that the layer consists of gelatine, starch, soaps, fatty alcohols, polyvinyl alcohol, water glass or of mixtures thereof.

34. Substrates according to claim 1 having a density of less than 0.45.

35. Substrate according to claim 1 being provided with a printing on at least one surface.

36. Substrate according to claim 1 being provided with a finish on at least one surface.

37. Substrate according to claim 1 being provided with a thin coating on at least one surface, the fibres protruding from the surface being embedded within the coating.

38. Substrate according to claim 37, noting that the coating has a thickness of less than 0.35 mm.

39. Substrate according to claim 37, noting that the non-ground surface of the carrier body is provided with a coating.

40. Substrate according to claim 1, noting that the non-ground surface is imprinted with a dispersion containing hollow microspheres.

41. Process for producing a pile-like substrate comprising the steps of applying or introducing under the action of pressure onto at least one surface of a textile carrier body consisting of fibres an aqueous dispersion of synthetic plastics material having been given a foam like condition by introducing therein air, of subsequently drying the impregnated carrier body by removing water and of finally grinding at least one impregnated surface of the carrier body.

42. Process according to claim 41, noting that the polymeric synthetic plastics material is introduced into the carrier body under the action of increased pressure.

43. Process according to claim 41, noting that the foam-like polymeric synthetic plastics material is introduced into the carrier body under the action of reduced pressure.

44. Process according to claim 41, noting that hollow microspheres of a thermoplastic synthetic plastics material are added to the aqueous dispersion of synthetic plastics material having been given a foam-like condition by introducing therein air.

45. Process according to claim 41, noting that compact particles consisting of a thermoplastic synthetic plastics material and containing an inflating agent are added to the aqueous dispersion of the synthetic plastics material having been given a foam-like condition by introducing therein air, hollow microspheres being formed in situ from the compact particles when supplying heat.

46. Process according to claim 45, noting that when drying the impregnated carrier body the hollow microspheres are simultaneously formed from the compact particles containing an inflating agent.

47. Process according to claim 41, noting that drying of the impregnated carrier body by supplying heat is effected such that the impregnated surface of the carrier body is brought in direct contact with a hot surface.

48. Process according to claim 41, noting that drying of the impregnated carrier body is effected by means of high frequency.

49. Process according to claim 41, noting that the aqueous dispersion of synthetic plastics material is exposed to heat-sensitive measures.

50. Process according to claim 49, noting that the aqueous dispersion of synthetic plastics material is exposed to polyvinylmethylether.

51. Process according to claim 41, noting that the aqueous dispersion of synthetic plastics material is adjusted to a pH-value which is different from the pH-value of the fibres forming the textile carrier body.

52. Process according to claim 41, noting that the fibres forming the textile carrier body are, prior to introducing therein the aqueous dispersion of synthetic plastics material, provided with a layer of a water-repellent material.

53. Process according to claim 41, noting that the fibres forming the textile carrier body are, prior to introducing the aqueous dispersion of synthetic plastics material, provided with a layer of a substance being soluble under the action of a liquid and noting that this substance is at least partially again removed under the action of said mentioned liquid during or after the solidification of the beaten foam.

54. Process according to claim 41, noting that the fibres forming the textile carrier body are impregnated with a solution, emulsion, dispersion or a gel containing a solid substance being soluble in a liquid.

55. Process according to claim 41, noting that the impregnated carrier body is, after having been dried, subjected to a chemical treatment.

56. Process according to claim 41, noting that the impregnated carrier body is, after having been dried, subjected to a mechanical treatment.

57. Process according to claim 41, noting that there is first introduced an aqueous dispersion of synthetic plastics material from one surface of the textile carrier body till approximately its central area and this dispersion is allowed to dry and there is subsequently introduced a further aqueous dispersion of synthetic plastics material from the opposite surface of the textile carrier body and this dispersion is allowed to dry.

58. Process according to claim 57, noting that said both dispersions of synthetic plastics material are different.

59. Process according to claim 41, noting that the increase in thickness of the textile carrier body is, after drying of the dispersion of synthetic plastics material, removed by the grinding treatment.

60. Process according to claim 41, noting that the impregnated carrier body is at least on its one surface provided with an embossing and compressed under the action of pressure and heat.

61. Process according to claim 41, noting that the impregnated carrier body is imprinted with a printing ink.

62. Process according to claim 41, noting that the impregnated carrier body is provided with a transparent finish.

63. Process according to claim 41, noting that the impregnated carrier body is, after grinding operation, subjected to a dying treatment.

64. Process according to claim 41, noting that a synthetic plastics material forming a coating is applied onto the impregnated surface of the carrier body in such a manner that the fibres protruding out of the surface are embedded within the coating.

* * * * *